United States Patent [19]

Pacault

[11] B 3,992,884

[45] Nov. 23, 1976

[54] THERMAL POWER PLANT

[75] Inventor: Pierre Henri Pacault, Ville d'Avray, France

[73] Assignee: Fives-Cail Babcock, Paris, France

[22] Filed: Jan. 3, 1975

[21] Appl. No.: 538,472

[44] Published under the second Trial Voluntary Protest Program on February 3, 1976 as document No. B 538,472.

[52] U.S. Cl. ..... 60/645; 60/676

[51] Int. Cl.[2] ..... F01K 21/00

[58] Field of Search ..... 60/644, 645, 650, 651, 60/670, 671, 676

[56] References Cited

UNITED STATES PATENTS 1,066,348 7/1913 Voorhees ..... 60/649

3,842,605 10/1974 Tegtmeyer ..... 60/678

*Primary Examiner*—Allen M. Ostrager

*Attorney, Agent, or Firm*—Kurt Kelman

[57] ABSTRACT

A portion of the steam produced in a nuclear power plant at relatively low pressure is substantially adiabatically compressed, and the compressed, heated steam is employed for superheating the steam supplied to one or both stages of a steam turbine which drives the generator. The energy gained by superheating may be greater than that spent in compressing a portion of the steam.

14 Claims, 2 Drawing Figures

THERMAL POWER PLANT

This invention relates to thermal power plants, and particularly to plants in which the steam which constitutes the working fluid for a prime mover is saturated or only weakly superheated when generated.

Power plants employing saturated or only weakly superheated steam have a thermodynamic efficiency of 35% or less. Such power plants include nuclear power plants in which a pressurized-water reactor or a boiling-water reactor provides the heat of vaporization for steam generation. Their low thermodynamic efficiency is one of the principal reasons for the high cost of construction of such plants, and for the thermal pollution caused by nuclear power plants.

The primary object of this invention is an improvement in the thermodynamic efficiency of nuclear power plants and other power plants employing steam as the working fluid for an engine.

It has been found that the thermal efficiency of a steam operated power plant supplied with saturated or only weakly supercharged steam can be improved compressing a portion of the available steam under conditions which cause heating of the compressed steam, and by employing the heated, compressed steam for further heating or superheating the steam employed as a working fluid.

The invention, in one of its aspects, provides an improvement in a method of operating a thermal power plant in which steam at a certain pressuree is generated in a steam generating zone, and generated steam is expanded in an engine to produce mechanical work. According to the invention, a first portion of the steam is withdrawn from the steam generating zone, compressed to a pressure higher than its original pressure in a manner to increase its temperature, and thermal energy is transferred from the compressed first steam portion to a second portion of the generated steam prior to expanding the second portion in the engine.

The invention also provides an improvement in a thermal power system including a source of thermal energy, a steam generator connected to the source for vaporizing water to steam by the thermal energy of the source, a steam-operated engine, and a conduit for supplying steam from the generator to the engine as a working fluid. According to this invention, a compressor is connected to the steam generator for receiving steam therefrom and for compressing, and for thereby heating the received steam. A heat transfer arrangement in the conduit is connected to the compressor for transferring thermal energy from the compressed heated steam to the working fluid for the engine.

Figure 1:
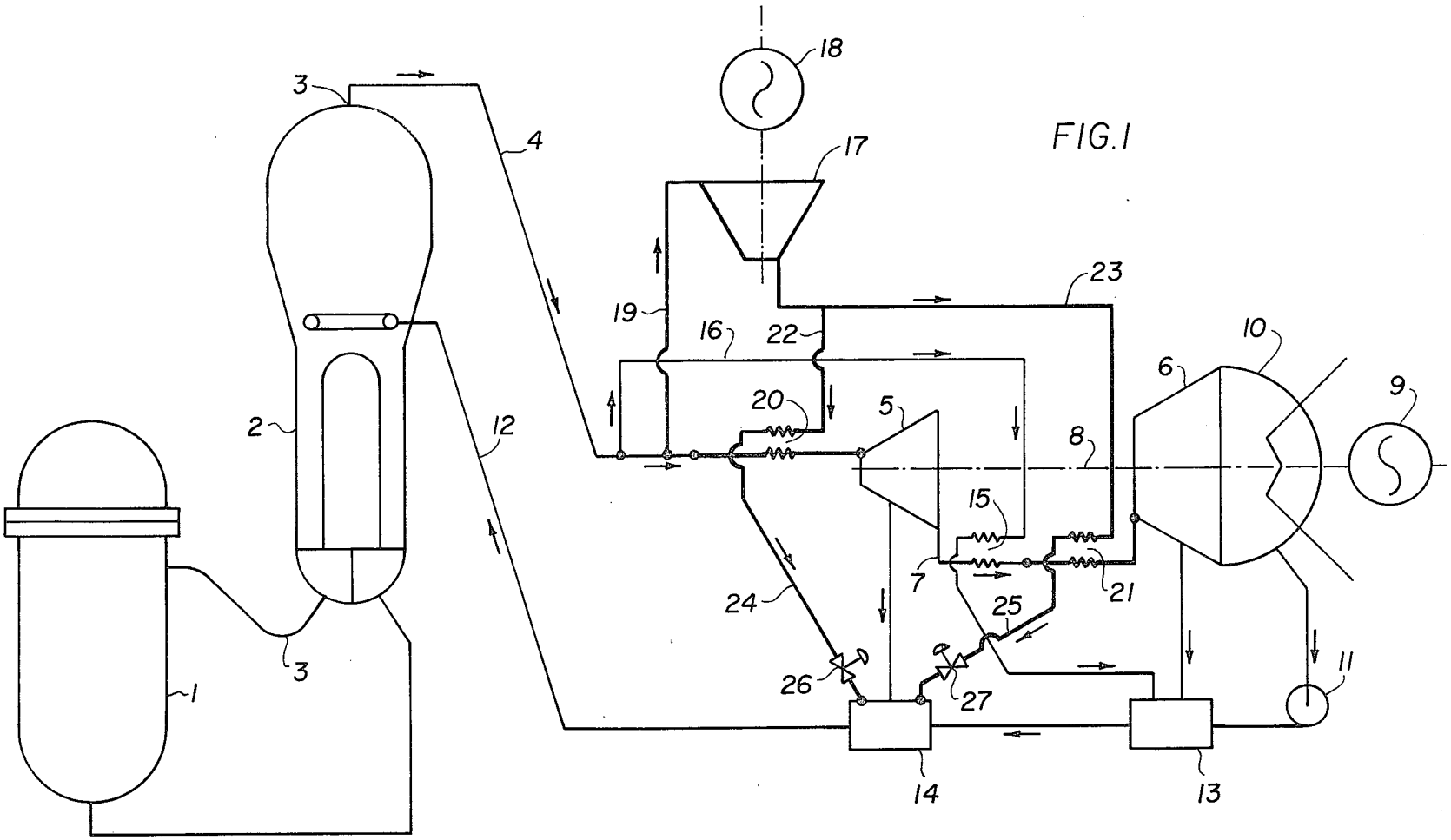
Figure 2:
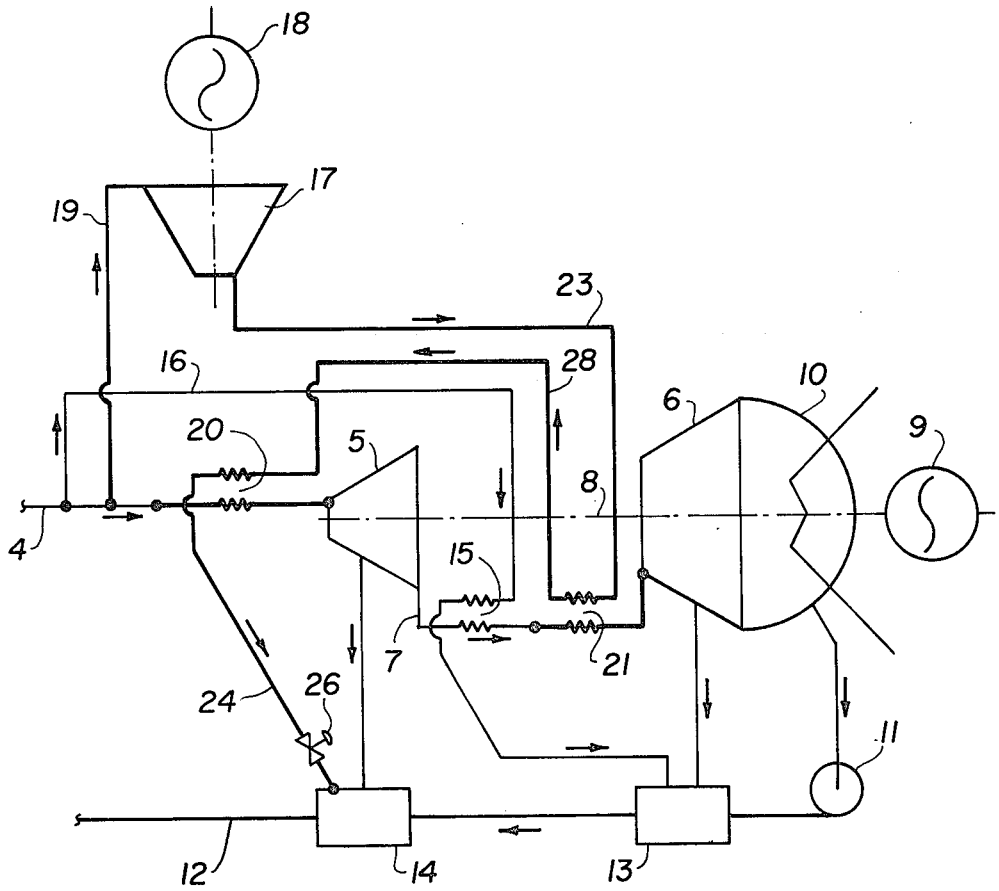

Other features, additional objects, and many of the attendant advantages of this invention will readily become apparent from the following detailed description of preferred embodiments when considered in connection with the appended drawing in which:

FIG. 1 is a flow sheet of a nuclear power plant according to this invention; and FIG. 2 illustrates a modification of the plant of FIG. 1 in a fragmentary analogous manner.

Referring initially to FIG. 1, there is shown as much of a nuclear power plant including a pressurized water reactor 1 as is needed for an understanding of the invention. The reactor is connected to a steam generator 2 by a primary loop 3. A steam line 4 supplies steam from the generator 2 to the high-pressure stage 5 of a two-stage steam turbine, the partly expanded steam being transmitted from the stage 5 to the low-pressure stage 6 of the turbine by a conduit 7. The shaft 8 of the turbine drives an electric generator 9. The expanded steam is fed to a condenser 10, and the condensate is returned to the steam generator 2 by a condensate pump 11 and a return line 12 including two reheaters 13, 14 connected to the two stages 5, 6 of the turbine respectively. A heat exchanger 15 in the conduit 7 heats the partly expanded steam released from the high-pressure stage 5 by means of live steam drawn from the generator 2 through the steam line 4 and a branch conduit 16, the heating steam and condensate being discharged from the heat exchanger 15 to the reheater 13. The elements described so far are conventional, and their structural details and functions are too well known to require more detailed description.

The invention provides a compressor 17 driven by an electric motor 18. The intake of the compressor is connected to the steam generator 2 by a branch conduit 19 and the steam line 4. The compressor 17 operates under approximately adiabatic conditions, and the compressed steam is discharged from the compressor at an increased temperature to two indirect heat exchangers 20, 21 by respective individual feed lines 22, 23. The heat exchanger 20 is arranged in the steam line 4 upstream from the high-pressure stage 5, and the heat exchanger 21 in the connecting conduit 7 between the heat exchanger 15 and the low-pressure stage 6 of the steam turbine.

The condensate formed from the compressed steam in the heat exchangers 20, 21 flows toward the reheater 14 through condensate lines 24, 25 equipped with respective pressure reducing valves 26, 27.

Superheating the steam supplied to the high-pressure stage 5 in the heat exchanger 20, and particularly the reheating and superheating of the partly expanded steam supplied to the low-pressure stage 6 in the heat exchanger 21 enhances the thermodynamic efficiency of the power plant as illustrated by the following example of an actual embodiment:

The steam generator 2 associated with a conventional pressurized-water reactor 1 produced saturated live steam at a pressure of 60 bars, and the low-pressure stage 6 of the turbine received the partly expanded steam at a pressure of about 10 bars. The plant was partly modified in the manner illustrated in FIG. 1, and a portion of the steam was compressed to 180 bars and employed for further heating the working fluid in the manner illustrated by the heat exchanger 21 in FIG. 1, whereby the partly expanded steam supplied to the low-pressure stage of the turbine was heated to 380°C. The thermodynamic efficifency of the plant was improved by 1.5%. It was additionally improved by 1.0% when a second heat exchanger was installed upstream from the high-pressure stage 5 as shown at 20 in FIG. 1. An improvement by even 1.5% is better than could be achieved by installing an integral economizer in the steam generator.

FIG. 2 shows a modification of the apparatus illustrated in FIG. 1 and described above in which the two heat exchangers 20, 21 are arranged in series. Compressed and heated steam supplied to the heat exchanger 21 through the feed 23 loses a part of its thermal energy to the steam, reheated in the heat exchanger 15 by steam supplied directly from the steam generator 2. A line 28 connects the heat exchanger 21 to the heat exchanger 20 where the previously compressed and heated steam is largely condensed, the condensate being released to the reheater 14 through the condensate line 24 and the pressure reducing valve.

The modified apparatus of FIG. 2 is somewhat less costly to build than that shown in FIG. 1, but is approximately equally effective if the compressed steam is supplied first to the heat exchanger 21.

At least some of the advantages of this invention can be achieved in a simplified apparatus, not shown, which lacks one of the two heat exchangers 20, 21.

The devices contributed by this invention to an otherwise conventional nuclear power plant, and particularly the compressor 17, may be arranged in an unshielded area of the plant and may thus be serviced or repaired without interrupting the operation of the plant, a significant advantage over other efficiency-improving modifications of similar plants which were proposed heretofore.

While the invention has been described in its application to a nuclear power plant, and provides greatest benefits to such plants at this time, it is equally applicable to other thermal power systems in which the steam generating zone supplies steam which is saturated or almost saturated. Sources of thermal energy other than a nuclear reactor may be combined with elements of this invention. Similarly, the steam may be expanded in an engine other than a turbine for producing mechanical work without losing the advantages of the invention.

Other changes and modifications will readily suggest themselves to those skilled in the art, and it should be understood that, within the scope of the appended claims, this invention may be practiced otherwise than as specifically illustrated and described.

What is claimed is:

1. In a method of operating a thermal power plant in which steam at a predetermined pressure is generated in a steam generating zone, and generated steam is expanded in an engine to produce mechanical work, the improvement which comprises withdrawing a first portion of the generated steam from said zone, compressing said first portion to a pressure higher than said predetermined pressure in a manner to increase the temperature of the compressed steam, and transferring thermal energy from said compressed first portion to a second portion of said generated steam prior to expanding said second portion in said engine.

2. In a method as set forth in claim 1, said thermal energy being transferred indirectly from said first portion to said second portion, and said first portion being condensed by said transferring.

3. In a method as set forth in claim 2, said condensed portion being recycled to said zone.

4. In a method as set forth in claim 1, said engine having a first stage and a second stage, said second portion passing sequentially through said first and second stages for expansion in each of said stages, said thermal energy being transferred to said second portion after expansion of said second portion in said first stage and prior to expansion of said second portion in said second stage.

5. In a method as set forth in claim 1, said engine having a first stage and a second stage, said second portion passing sequentially through said first and second stages for expansion in each of said stages, a portion of said thermal energy being transferred to said second portion prior to the expansion of said second portion in said first stage, and another portion of said thermal energy being transferred to said second portion after expansion of said second portion in said first stage and prior to expansion of said second portion in said second stage.

6. In a method as set forth in claim 5, said first portion being divided into two parts after said compressing, thermal energy being transferred from said parts respectively to said second portion prior to said expansion in said first stage and after said expansion in said first stage.

7. In a method as set forth in claim 5, said thermal energy being transferred indirectly from said first to said second portion sequential heat exchange between said first portion and respective parts of said second portion after and before expansion in said first stage.

8. In a thermal power system including a source of thermal energy, steam generator means connected to said source for vaporizing water to steam by the thermal energy of said source, a steam-operated engine, and conduit means for supplying steam from said generator means to said engine as a working fluid, the improvement which comprises:

a. compressor means connected to said steam generator means for receiving steam therefrom, for compressing and for thereby heating the received steam; and b. heat transferring means in said conduit means connected to said compressor means for transferring thermal energy from said compressed, heated steam to said working fluid.

9. In a system as set forth in claim 8, means connected to said heat transferring means for releasing the pressure from condensate formed in said heat transferring means from said compressed, heated steam by heat transfer to said working fluid.

10. In a system as set forth in claim 9, means for recycling said condensate to said steam generator means after said pressure releasing.

11. In a system as set forth in claim 8, said engine having first and second stages and including means for sequentially passing said working fluid through said first and second stages for expansion of said working fluid in each of said stages, said heat transferring means including a heat exchanger operatively interposed between said stages for transfer of thermal energy to the working fluid partly expanded in said first stage.

12. In a system as set forth in claim 11, said heat transferring means further including another heat exchanger, said other heat exchanger being operatively interposed between said source and said first stage.

13. In a system as set forth in claim 11, each of said heat exchangers being individually connected to said compressor means.

14. In a system as set forth in claim 11, said heat exchangers being connected in series to said compressor means.

* * * * *